US009383090B2

(12) United States Patent
Scarlata et al.

(10) Patent No.: US 9,383,090 B2
(45) Date of Patent: Jul. 5, 2016

(54) FLOODLIGHTS WITH MULTI-PATH COOLING

(71) Applicants: Andrew Francis Scarlata, West Monroe, NY (US); Graig Edmund DeCarr, Cicero, NY (US)

(72) Inventors: Andrew Francis Scarlata, West Monroe, NY (US); Graig Edmund DeCarr, Cicero, NY (US)

(73) Assignee: Cooper Technologies Company, Houston, TX (US)

( * ) Notice: Subject to any disclaimer, the term of this patent is extended or adjusted under 35 U.S.C. 154(b) by 29 days.

(21) Appl. No.: 14/152,598

(22) Filed: Jan. 10, 2014

(65) Prior Publication Data

US 2015/0198310 A1 Jul. 16, 2015

(51) Int. Cl.

| | |
|---|---|
| ***F21V 29/507*** | (2015.01) |
| *F21V 29/74* | (2015.01) |
| *F21V 23/02* | (2006.01) |
| *F21Y 101/02* | (2006.01) |
| *F21V 21/30* | (2006.01) |

(52) U.S. Cl.

CPC ..... *F21V 29/507* (2015.01); *F21V 21/30* (2013.01); *F21V 23/023* (2013.01); *F21V 29/74* (2015.01); *F21Y 2101/02* (2013.01)

(58) Field of Classification Search

CPC ..... H01L 23/34; H01L 23/36; H01L 23/3675; H01L 23/40; H01L 23/4012; F21S 48/32–48/328; F21V 29/00; F21V 29/002

USPC ..... 313/45

See application file for complete search history.

(56) References Cited

U.S. PATENT DOCUMENTS

| | | | |
|---|---|---|---|
| D136,799 | S | 12/1943 | Vendope |
| 3,585,380 | A | 6/1971 | Friedman et al. |
| 3,619,602 | A | 11/1971 | Wilde |
| 6,065,854 | A | 5/2000 | West et al. |
| 6,095,671 | A | 8/2000 | Hutain |
| 6,435,699 | B2 | 8/2002 | Glowach, Sr. et al. |

(Continued)

FOREIGN PATENT DOCUMENTS

| | | |
|---|---|---|
| CN | 200965196 | 10/2007 |
| CN | 201149185 | 11/2008 |

(Continued)

OTHER PUBLICATIONS

Cooper Crouse-Hinds, "VMVIG and DMVIG Series CHAMP Induction Luminaires with Induction Lighting System", Product Brochure, Jun. 2005, pp. 1-8, Cooper Crouse-Hinds, USA.

(Continued)

*Primary Examiner* — Anh Mai
*Assistant Examiner* — Nathaniel Lee
(74) *Attorney, Agent, or Firm* — King & Spalding LLP

(57) ABSTRACT

A floodlight can include a light source housing assembly, a power source housing assembly, and an intermediate housing assembly mechanically coupled to the light source housing assembly and the power source housing assembly. The light source housing assembly can include a first heat sink having a front side and a back side, where the back side includes a number of protrusions extending from a first remainder of the back side, and at least one light source mounted to the front side of the first heat sink. The power source housing assembly can include a second heat sink having a front side and a back side, and at least one power source assembly mounted to the back side of the second heat sink and electrically coupled to the at least one light source. The intermediate housing assembly can include a front side and a back side.

20 Claims, 7 Drawing Sheets

(56) References Cited

U.S. PATENT DOCUMENTS

| | | | | |
|---|---|---|---|---|
| 6,659,622 | B2 | 12/2003 | Katogi et al. | |
| 6,731,077 | B1 | 5/2004 | Cheng | |
| 7,021,793 | B2 | 4/2006 | Biasoli et al. | |
| 7,524,089 | B2 | 4/2009 | Park | |
| 7,766,508 | B2 | 8/2010 | Villard et al. | |
| 7,780,318 | B2 | 8/2010 | Xiao et al. | |
| 7,789,530 | B2 | 9/2010 | Stein et al. | |
| D625,870 | S | 10/2010 | Feigenbaum | |
| 7,828,465 | B2 | 11/2010 | Roberge et al. | |
| 7,832,897 | B2 | 11/2010 | Ku | |
| 7,854,534 | B2 | 12/2010 | Liu | |
| 7,918,591 | B2 | 4/2011 | Lynch | |
| D641,905 | S | 7/2011 | Janssen | |
| 7,993,033 | B2 | 8/2011 | Moriyama et al. | |
| D645,593 | S | 9/2011 | Janssen | |
| D645,594 | S | 9/2011 | Grawe | |
| 8,057,057 | B2 | 11/2011 | Park | |
| 8,066,403 | B2 | 11/2011 | Sanfilippo et al. | |
| D650,505 | S | 12/2011 | Oka | |
| 8,092,049 | B2 | 1/2012 | Kinnune et al. | |
| 8,115,395 | B2 | 2/2012 | Horng et al. | |
| D663,877 | S | 7/2012 | Quevy et al. | |
| D667,582 | S | 9/2012 | Toft | |
| 8,287,151 | B2 | 10/2012 | Chung et al. | |
| 8,292,449 | B2 | 10/2012 | Poissonnet et al. | |
| 8,408,739 | B2 | 4/2013 | Villard et al. | |
| 8,434,898 | B2 | 5/2013 | Sanfilippo et al. | |
| 8,455,901 | B2 | 6/2013 | Chan et al. | |
| 2003/0142499 | A1 | 7/2003 | Chiu | |
| 2008/0062682 | A1 | 3/2008 | Hoelen et al. | |
| 2009/0262533 | A1 | 10/2009 | Liu et al. | |
| 2009/0289160 | A1 | 11/2009 | Kludt | |
| 2010/0014289 | A1 | 1/2010 | Thomas et al. | |
| 2010/0026157 | A1* | 2/2010 | Tanaka | F21K 9/1355 313/45 |
| 2010/0232155 | A1 | 9/2010 | Wang | |
| 2010/0259935 | A1 | 10/2010 | Scordino et al. | |
| 2011/0013395 | A1 | 1/2011 | Melzner et al. | |
| 2011/0019416 | A1 | 1/2011 | Poissonnet et al. | |
| 2011/0068708 | A1 | 3/2011 | Coplin et al. | |
| 2011/0110081 | A1 | 5/2011 | Belknap et al. | |
| 2011/0141728 | A1 | 6/2011 | Russello et al. | |
| 2011/0204790 | A1* | 8/2011 | Arik | F21V 29/02 315/113 |
| 2011/0235330 | A1 | 9/2011 | Pedersen et al. | |
| 2011/0242822 | A1 | 10/2011 | Rong et al. | |
| 2011/0249427 | A1 | 10/2011 | Rooms et al. | |
| 2011/0253358 | A1* | 10/2011 | Huang | F21K 9/135 165/185 |
| 2011/0285292 | A1 | 11/2011 | Mollnow | |
| 2011/0292656 | A1 | 12/2011 | Saxena | |
| 2011/0309751 | A1 | 12/2011 | Ter-Hovhannisyan | |
| 2012/0086340 | A1 | 4/2012 | Hashizume | |
| 2012/0127702 | A1 | 5/2012 | Lax et al. | |
| 2012/0170255 | A1 | 7/2012 | McMillan | |
| 2012/0176790 | A1 | 7/2012 | Kinnune et al. | |
| 2012/0230030 | A1 | 9/2012 | Miller et al. | |
| 2012/0250321 | A1* | 10/2012 | Blincoe | F21V 21/00 362/247 |
| 2012/0281409 | A1 | 11/2012 | Patkus et al. | |
| 2013/0077339 | A1 | 3/2013 | Moyer | |
| 2013/0083546 | A1 | 4/2013 | Duan et al. | |
| 2013/0088882 | A1 | 4/2013 | Guercio et al. | |
| 2013/0094226 | A1 | 4/2013 | Huang et al. | |
| 2013/0114262 | A1 | 5/2013 | McClellan | |
| 2013/0279172 | A1 | 10/2013 | Wang | |
| 2013/0279179 | A1 | 10/2013 | Pearson et al. | |

FOREIGN PATENT DOCUMENTS

| | | |
|---|---|---|
| CN | 101761801 | 6/2010 |
| CN | 201615398 | 10/2010 |
| CN | 202442142 | 9/2012 |
| CN | 202852608 | 4/2013 |
| CN | 202884632 | 4/2013 |
| CN | 203240308 | 10/2013 |
| JP | 13048026 | 3/2013 |
| KR | 20-2008-0000034 | 1/2008 |
| KR | 20-0447539 | 2/2010 |
| KR | 100945420 | 8/2010 |
| KR | 10-0997746 | 12/2010 |
| KR | 101113292 | 2/2012 |

OTHER PUBLICATIONS

Cooper Crouse-Hinds, "Flood Light Fixtures", Product Brochure, 2001, pp. 1-12, Cooper Crouse-Hinds, USA.

E.Eskina and S. Ionov, Federal Institute of Industrial Property, International Search Report and Written Opinion issued in international application No. PCT/US 2015/010683, completed Mar. 23, 2015, mailed Apr. 16, 2015, 7 pages, Federal Institute of Industrial Property, Moscow, Russia.

The State Intellectual Property Office of China, Office Action issued in Chinese patent application No. 201280015993.9, issue date Sep. 6, 2015, total 24 pages with translation of office action.

Translation of CN 101761801 generated from Lexis Nexis Total Patents, 3 pages.

Translation of CN 201615398 generated from Lexis Nexis Total Patents, 2 pages.

Translation of CN 200965196 generated from Lexis Nexis Total Patents, 3 pages.

The State Intellectual Property Office of China, Office Action issued in Chinese patent application No. 201280015993.9, issue date Apr. 20, 2016, total 16 pages with translation of office action.

Translation of CN 201149185 generated from Lexis Nexis Total Patents, 6 pages.

* cited by examiner

FLOODLIGHTS WITH MULTI-PATH COOLING

CROSS-REFERENCE TO RELATED APPLICATIONS

The present application is related to U.S. patent application Ser. No. 14/152,581 titled "Assembly Systems for Modular Light Fixtures," which is being filed concurrently with the U.S. Patent and Trademark Office, and is hereby incorporated by reference in its entirety.

The present application is also related to U.S. patent application Ser. No. 13/436,172 titled "Light-Emitting Diode (LED) Floodlight", which itself claims priority from U.S. Provisional Patent Application No. 61/470,554, titled "Light-Emitting Diode (LED) Floodlight". The entire contents of both are hereby incorporated herein by reference.

TECHNICAL FIELD

The present disclosure relates generally to floodlights and more particularly to systems, methods, and devices for a light emitting diode (LED) floodlight with multi-path cooling.

BACKGROUND

Floodlights are used in many different applications. Such floodlights may be used, for example, in commercial applications and residential applications. Floodlights may also be used in industrial applications and other harsh environments, including but not limited to military applications, onboard ships, assembly plants, power plants, oil refineries, and petrochemical plants. When a floodlight is used in such harsh environments, the floodlight must comply with one or more standards and/or regulations to ensure safe and reliable operation. With the development of lighting technologies (e.g., light emitting diode (LED)) that offer alternatives to incandescent lamps, floodlights using such lighting technologies are becoming more common.

SUMMARY

In general, in one aspect, the disclosure relates to a floodlight having a light source housing assembly, a power source housing assembly, and an intermediate housing assembly. The light source housing assembly can include a thermally conductive first heat sink having a front side and a back side, where the back side has a number of protrusions extending from a remainder of the back side. The light source housing assembly can also include a at least one light source mounted to the front side of the first heat sink. The power source housing assembly can include a thermally conductive second heat sink having a front side and a back side. The power source housing assembly can also include at least one power source assembly mounted to the back side of the second heat sink and electrically coupled to the at least one light source. The intermediate housing assembly can be disposed between and mechanically coupled to the light source housing assembly and the power source housing assembly, where the intermediate housing assembly includes front side and a back side. The remainder of the back side of the first heat sink, the protrusions of the first heat sink, and the front side of the intermediate housing assembly form a number of air gaps.

These and other aspects, objects, features, and embodiments will be apparent from the following description and the appended claims.

BRIEF DESCRIPTION OF THE DRAWINGS

The drawings illustrate only exemplary embodiments and are therefore not to be considered limiting of its scope, as the exemplary embodiments may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
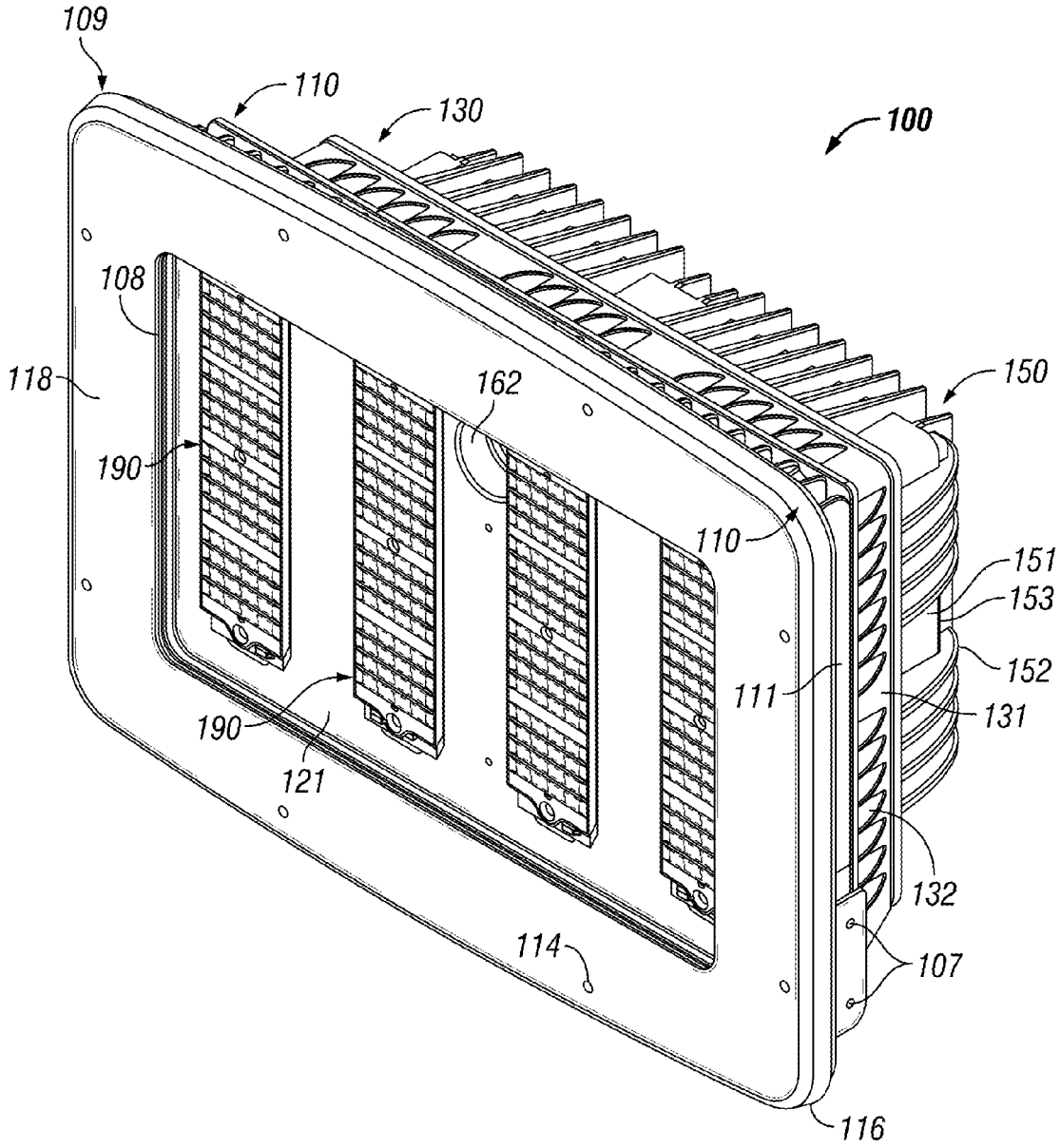
FIGS. 1A-1D show various views of a floodlight in accordance with certain example embodiments.

The example embodiments discussed herein are directed to systems, apparatuses, and methods associated with a floodlight. While the Figures shown and described herein are directed to LED floodlights, the disclosed embodiments are also applicable to one or more other types of light fixtures (e.g., spotlights, nightlights, emergency egress lights, high-bay light fixtures). Generally, the floodlight can be called a light fixture herein. Example embodiments can be used in one or more of a variety of environments, indoors or outdoors, where the light fixture can be exposed. Example environments can include, but are not limited to, conditions with moisture, humidity, dirt, exhaust fumes, vibrations, potential explosions, and noise.

Example floodlights can use LED technology. The LED can be one or more of a number of types of LED technology, including but not limited to discrete LEDs, LED arrays, chip-on-board LEDs, edge lit LED panels, and surface mounted LEDs. One or more LEDs can be mounted on a light board, and a LED floodlight can include one or more light boards. Example floodlights can also be used with different types of light sources using one or more of a number of types of sockets into which the light sources are electrically and mechanically coupled. Examples of a socket can include, but are not limited to, an Edison screw base of any diameter (e.g., E26, E12, E 14, E39), a bayonet style base, a bi-post base, a bi-pin connector base, a wedge base, and a fluorescent tube base. A light source can electrically and mechanically couple to the socket and can be of a light source type that corresponds to the socket. Examples of light source types can include, but are not limited to, incandescent lamps, LEDs, halogen lamps, G10/GU10, G9/GU9, AR111/PAR36, T3, MR-11, and MR-16.

Example floodlights can be of any size and/or shape. A floodlight can be mounted to a surface (e.g., wall, ceiling, pillar), can be a light module in a light fixture, and/or can be used with any other suitable mounting instrument. Such floodlights can be used in residential, commercial, and/or industrial applications. Such floodlights can operate from a manual device (e.g., on/off switch, dimming switch, pull chain), a photocell, a timer, and/or any other suitable mechanism.

The floodlight (or components thereof) described herein can be made of one or more of a number of suitable materials to allow the floodlight to meet certain standards and/or regulations while also maintaining durability in light of the one or more conditions under which the example floodlight can be exposed. Examples of such materials can include, but are not limited to, aluminum, stainless steel, fiberglass, glass, plastic, and rubber. Floodlights described herein can be rated for one or more of a number (or range) of light color (CCT), light accuracy (CRI), voltages, and/or amperes. Example floodlights described herein should not be considered limited to a particular CCT, CRI, voltage, and/or amperage rating.

In one or more example embodiments, a floodlight is subject to meeting certain standards and/or requirements. For example, the International Electrotechnical Commission (IEC) publishes ratings and requirements for LED floodlights. Specifically, the IEC publishes IP (which stands for Ingress Protection or, alternatively, International Protection) Codes that classify and rate the degree of protection provided against intrusion of solid objects, dust, and water in mechanical casings and electrical enclosures. One such IP Code is IP66, which means that a LED floodlight having such a rating is dust tight and protects against powerful water jets (in this case, 100 liters of water per minute under a pressure of 100 $kN/m^2$ at a distance of 3 meters) for a duration of at least 3 minutes.

The IEC also publishes temperature ratings for electrical equipment. For example, if a device is classified as having a T4 temperature rating, then the surface temperature of the device will not exceed 135° C. Other entities (e.g., the National Electrical Manufacturers Association (NEMA), the National Electric Code (NEC), Underwriters' Laboratories, Inc. (UL)) may also publish standards and/or requirements for LED floodlights.

Example embodiments of floodlights may meet one or more of a number of standards set by one or more of a number of authorities. Examples of such authorities include, but are not limited to, the National Electric Code (NEC), the Canadian Electric Code (CEC), the IEC, the NEMA, Underwriter's Laboratories (UL), the Standards Council of Canada, Conformité Européenne (CE), and the Appareils destinés à être utilisés en Atmosphères Explosives (ATEX). Examples of such standards include, but are not limited to, Class I, division 2, groups A, B, C, and/or D; Class I, Zone 2; Class II, groups E, F, and/or G; Class III simultaneous presence; Marine and/or Wet locations; Type 4X; IP66; and Ex nA Zone 2.

In addition, the floodlights described herein are rectangular in shape. In other words, each assembly and/or member of the example floodlights shown and described herein are substantially rectangular. One or more assemblies and/or members of an example floodlight can have any of a number of other shapes, including but not limited to circular, oval, hexagonal, square, and triangular.

A user as described herein may be any person that interacts, directly or remotely, with a floodlight. Specifically, a user may install, maintain, operate, and/or interface with a floodlight. Examples of a user may include, but are not limited to, an engineer, an electrician, an instrumentation and controls technician, a mechanic, an operator, a consultant, a contractor, and a manufacturer's representative.

Example embodiments will now be described in detail with reference to the accompanying figures, in which example embodiments of floodlights are shown. Floodlights may, however, be embodied in many different forms and should not be construed as limited to the example embodiments set forth herein. Rather, these example embodiments are provided so that this disclosure will be thorough and complete, and will fully convey the scope of floodlights to those of ordinary skill in the art. Like, but not necessarily identical, elements (also sometimes called assemblies, members, or components) in the various figures are denoted by like reference numerals for consistency.

Terms such as "first," "second," "top," "width," "height," and "back" are used merely to distinguish one component (or part of a component or state of a component) from another. Such terms are not meant to denote a preference or a particular orientation, and are not meant to limit embodiments of floodlights. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1B:
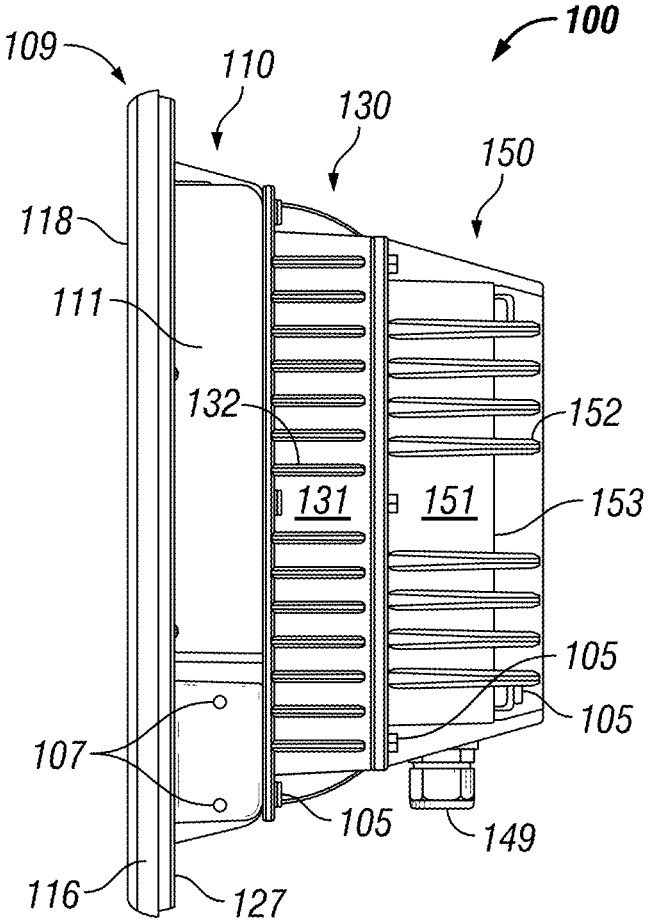
Figure 1C:
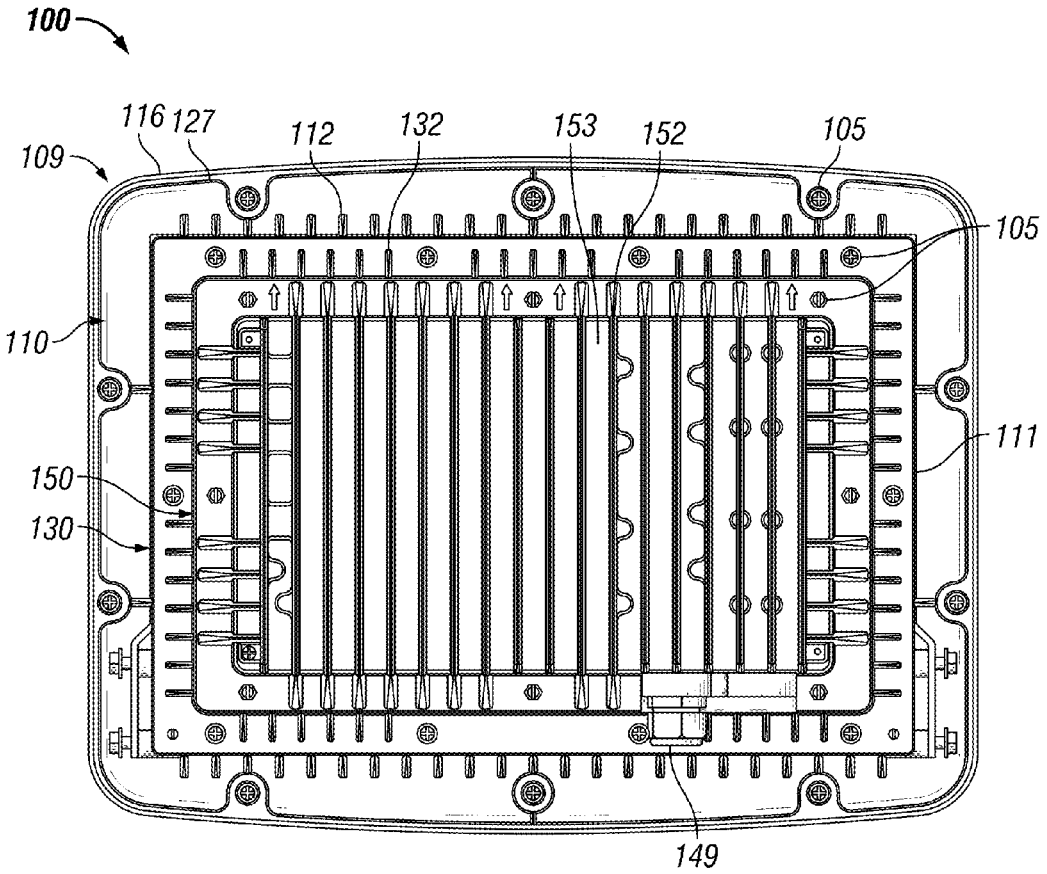
Figure 1D:
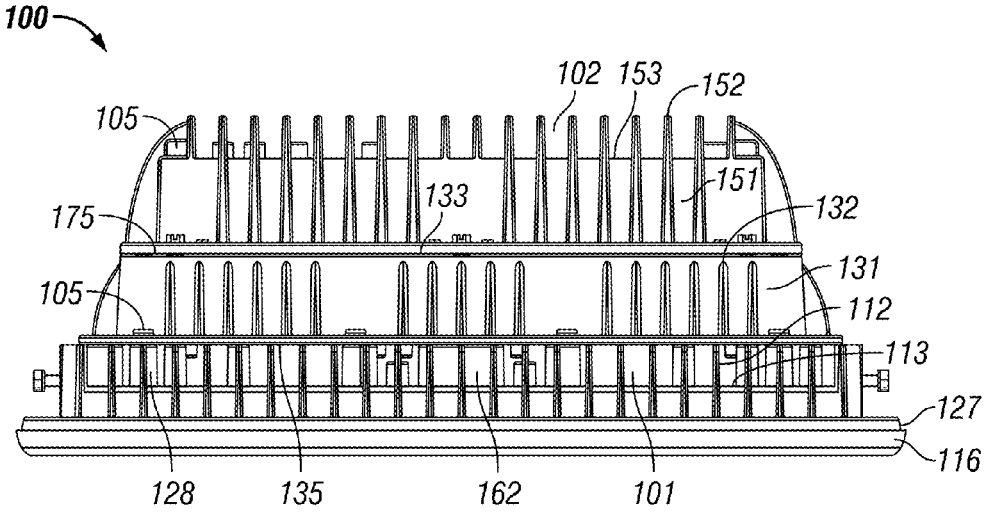
Figure 2A:
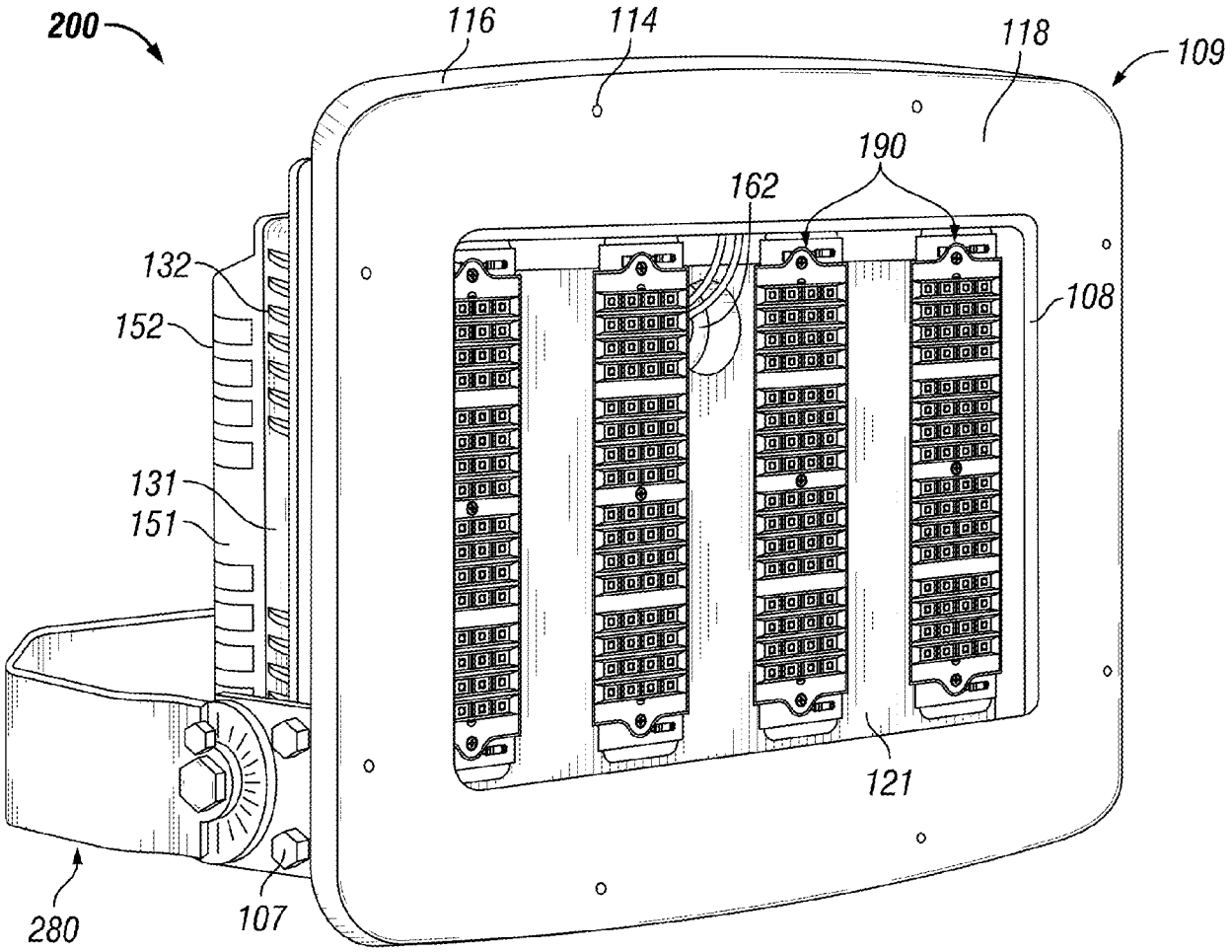
FIGS. 2A-2C show various views of the floodlight of FIGS. 1A-1D with an optional mounting assembly in accordance with certain example embodiments.
Figure 2B:
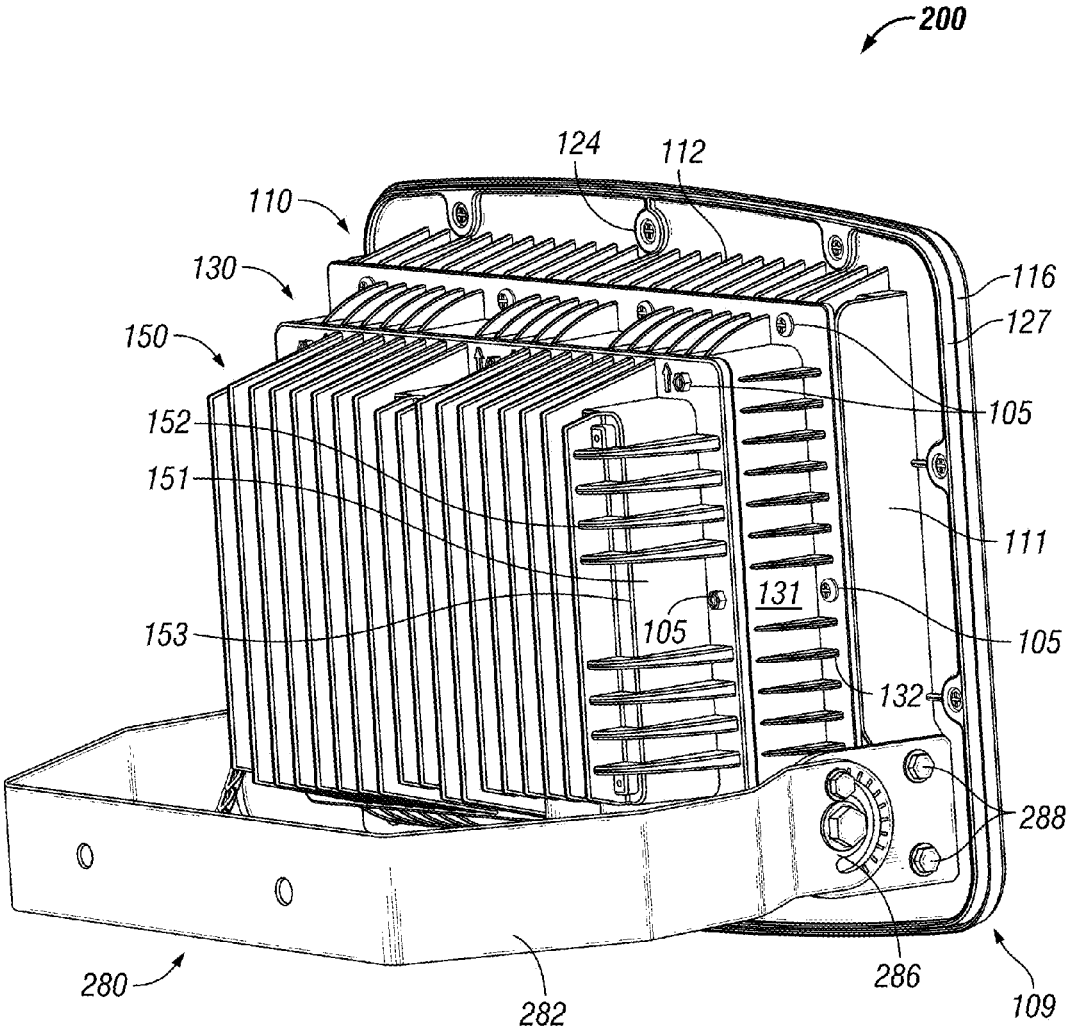
Figure 2C:
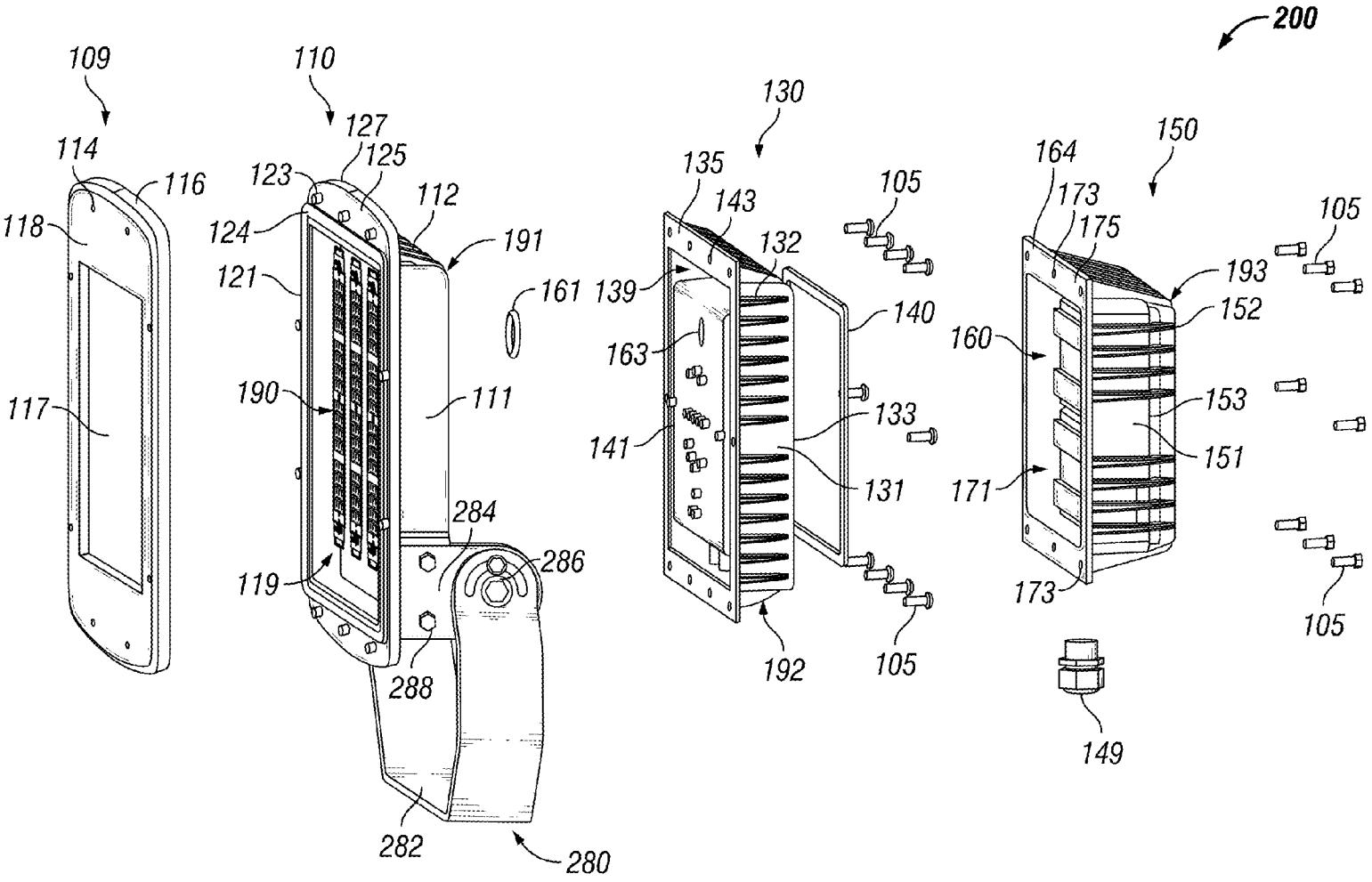

FIGS. 1A-1D show various views of a floodlight 100 in which one or more example embodiments may be implemented. Specifically, FIG. 1A shows a front perspective view of the floodlight 100. FIG. 1B shows a side view of the floodlight 100. FIG. 1C shows a rear view of the floodlight 100. FIG. 1D shows a top view of the floodlight 100. In addition, FIGS. 2A-2C show various views of the floodlight 200 of FIGS. 1A-1D with an optional mounting assembly 280 in accordance with certain example embodiments. FIG. 2A shows a front perspective view of the floodlight 200. FIG. 2B shows a rear perspective view of the floodlight 200. FIG. 2C shows an exploded view of the floodlight 200. In one or more embodiments, one or more of the components shown in FIGS. 1A-2C may be omitted, repeated, and/or substituted. Accordingly, embodiments of a floodlight should not be considered limited to the specific arrangements of components shown in FIGS. 1A-2C.

Referring to FIGS. 1A-2C, the floodlight 100 can include a light source housing assembly 110, a power source housing assembly 150, an intermediate housing assembly 130, and an optional mounting assembly 280. When the optional mounting assembly 280 is included, the floodlight 100 can be referred to as the floodlight 200. The light source housing assembly 110 can include a heat sink 191 and at least one light source 190 mounted on a front side 121 of the heat sink 191. In addition to the front side 121, the heat sink 191 can include one or more protrusions 112 that extend beyond a back side 113, a flange 125 disposed around the outer perimeter of the front side 121, and one or more coupling features 123 disposed on the flange 125. In certain example embodiments, the front side 121 can be offset from (e.g., recessed, protruding) the flange 125. If the front side 121 is recessed relative to the flange 125, as shown in FIGS. 1A-1D, a cavity 119 can be formed.

The one or more coupling features 123 disposed on the flange 125 (or, in certain example embodiments, on other portions of the heat sink 191) of the light source housing assembly 110 can allow the heat sink 191 to become mechanically coupled, directly or indirectly, to one or more other components of the floodlight 100. For example, the one or more coupling features 123 of the flange 125 can be used to mechanically couple the heat sink 191 to the bezel 109. The coupling features 123 can include, but are not limited to, a portion of a hinge, an aperture (as shown), a slot, a tab, a detent, and a mating thread. The heat sink 191 and another component of the floodlight 100 can be coupled to each other by the direct use of the coupling features 123. In addition, or in the alternative, the heat sink 191 and another component of the floodlight 100 can be coupled to each other using one or more independent devices that interact with the coupling features 123 disposed on the flange 125 of the heat sink 191. Examples of such devices can include, but are not limited to, a pin, a hinge, a fastening device 105 (e.g., screw, bolt), and a spring.

In certain example embodiments, the heat sink 191 can include one or more protrusions 112 extending from the back side 113 of the heat sink 191. The protrusions 112 can be called fins or some similar name. The protrusions 112 can be used to increase the effective surface area of the back side 113 of the heat sink 191. In such a case, the protrusions 112 and the back side 113 of the heat sink 191 can dissipate heat absorbed from the at least one light source 190 more efficiently. In certain example embodiments, in addition to extending beyond the back side 113 of the heat sink, the protrusions can extend outward from the top, one or both sides 111, and/or the bottom of the heat sink 191.

In certain example embodiments, the protrusions 112 provide one or more air gaps 101 between the back side 113 of the heat sink 191 and the intermediate housing assembly 130. The air gaps 101 may be used to maintain the temperature of the light source housing assembly 110 and/or the intermediate housing assembly 130 below a threshold temperature. Specifically, the heat radiated by the heat sink 191 radiates into the air gaps 101, which causes the air gaps 101 to heat to a temperature (greater than the ambient temperature but less than the threshold temperature) when the light sources 190 are illuminated.

When the temperature in the air gaps 101 is greater than the ambient temperature, the ambient air can flow through the air gaps 101, causing the air gaps 101 to cool to lower temperature, which is greater than the ambient temperature but less than the initial temperature of the air gaps 101 prior to the ambient air flowing through the air gaps 101. The ambient air can be forced to flow through the air gaps 101 based on a pressure differential between the air gaps 101 and outside the air gaps 101. In such a case, the pressure differential can be caused by the higher temperature in the air gaps 101 relative to the lower temperature of the ambient air outside the air gaps 101.

The threshold temperature may represent an operating temperature at which the floodlight 100 and/or one or more components (e.g., the Light sources 190) of the floodlight 100 may fail. The air gaps 101 between the light source housing assembly 110 and the power source housing assembly 150 may be created by one or more heat sink protrusions 112 of the light source housing assembly 110. For example, as shown in FIGS. 1A-1D, each protrusion 112 of the heat sink 191 of the light source housing assembly 110 may extend from the back side 113 of the heat sink 191 and abut against the flange 135 of the intermediate housing assembly 130, described below.

Thus, the air gaps 101 can be used to maintain the temperature of the light source housing assembly 110 and the intermediate housing assembly 130 (and/or one or more of their components) below a threshold temperature. The protrusions 112 of the heat sink 191 may have varying shapes (e.g., thickness, height, curvature) and/or varying spacing extending from the heat sink 191. For example, the protrusions 112 may be fins (e.g., blades). As another example, the protrusions 112 may be one or more undulations (e.g., a number of sine waves in series). The protrusions 112 may extend from the back side 113 of the heat sink 191 perpendicularly or at some non-normal angle. Each protrusion 112 may extend from the back side 113 of the heat sink 191 at the same or different angles relative to the other protrusions 112.

The protrusions 112 may have any of a number of configurations. As shown in FIGS. 1A-1D, the protrusions 112 may be linear. In such a case, the linear protrusions 112 may have a number of orientations along the back side 113 of the heat sink 191. For example, the protrusions 112 may be parallel to each other and run vertically along at least a portion of the height of the back side 113 of the heat sink 191. The protrusions 112 may also be parallel to each other and run horizontally along at least a portion of the width of the back side 113 of the heat sink 191. The protrusions 112 may also be parallel to each other and run diagonally, at any of a number of angles, along at least a portion of the width of the back side 113 of the heat sink 191.

The protrusions 112 may also run quasi-parallel to each other. In a quasi-parallel configuration, a portion of the protrusions 112 may be parallel to each other, while the remainder of the protrusions 112 are not parallel to the portion of parallel protrusion(s) 112. For example, half of the protrusions 112 may be positioned vertically along the back side 113 of the heat sink 191, while the other half of the protrusions 112 may be positioned horizontally along the back side 113 of the heat sink 191. Those skilled in the art will appreciate that a number of other quasi-parallel configurations of the protrusions 112 along the back side 113 of the heat sink 191 may be attained.

The protrusions 112 may also be non-linear and/or oriented antiparallel to each other. For example, the protrusions 112 may be sine waves that run parallel to each other in some orientation (e.g., vertical, horizontal) along the back side 113 of the heat sink 191. As another example, the protrusions 112 may be concentric circles, positioned along the back side 113 of the heat sink 191, that are centered at the center of the heat sink 191. Those skilled in the art will appreciate that a number of other non-linear and antiparallel configurations of the protrusions 112 along the back side 113 of the heat sink 191 may be attained.

The protrusions 112 can be made of one or more of a number of thermally conductive materials. The protrusions 112 can be made of the same, or different, material compared to the material of the rest of the heat sink 191. The protrusions 112 can be part of a single piece with the rest of the heat sink 191. Alternatively, the protrusions 112 can be mechanically coupled to the rest of the heat sink 191 using one or more of a number of coupling methods, including but not limited to welding, compression fittings, and fastening devices. In certain example embodiments, the protrusions 112 can be considered part of the back side 113 of the heat sink 191.

In certain example embodiments, the back side 113 and/or the far end of the protrusions 112 of the heat sink 191 include one or more coupling features 128. The one or more coupling features 128 disposed on the back side 113 and/or the far end of the protrusions 112 of the heat sink 191 can allow the heat sink 191 to become mechanically coupled, directly or indirectly, to one or more other components of the floodlight 100. For example, the one or more coupling features 128 of the heat sink 191 can be used to mechanically couple the heat sink 191 to the intermediate housing assembly 130. The coupling features 128 can include, but are not limited to, a portion of a hinge, an aperture (as shown), a slot, a tab, a detent, and a mating thread. The heat sink 191 and another component of the floodlight 100 can be coupled to each other by the direct use of the coupling features 128. In addition, or in the alternative, the heat sink 191 and another component of the floodlight 100 can be coupled to each other using one or more independent devices that interact with the coupling features 128 disposed on the back side 113 and/or the far end of the protrusions 112 of the heat sink 191. Examples of such devices can include, but are not limited to, a pin, a hinge, a fastening device 105 (e.g., screw, bolt), and a spring.

In this particular example, the coupling features 128 receive fastening devices 105 to couple the light source housing assembly 110 to the intermediate housing assembly 130. The coupling features 128 may be configured in any manner appropriate to receive the corresponding fastener devices 105. For example, as shown in FIGS. 1A-1D, each fastener receiver 128 may be a threaded aperture that traverses some or all of the heat sink 191 from the back side 113 of the heat sink 191 and receives a fastener device 105 (e.g., a bolt). As another example, the fastener receiver 128 may be a slot, integrated with the end of one or more of the protrusions 112, that receives a clip or a clamp. The coupling features 128 can be aligned with corresponding fastener receivers 133 of the intermediate housing assembly 130, described below.

In certain example embodiments, the heat sink 191 of the light source housing assembly 110 also includes one or more coupling features 107 (hidden from view by fastening devices 288). In the case shown in FIGS. 1A-1D, at least one coupling feature 107 is positioned on each side 111 of the heat sink 191 toward the bottom of the light source housing assembly 110. The coupling features 107 may be configured in any manner appropriate to receive and couple to the mounting assembly 280. For example, as shown in FIGS. 1A-2C, the coupling features 107 may include one or more apertures for receiving fastening devices 288 (e.g., bolts) to couple the mounting assembly 280 to the heat sink 191 of the light source housing assembly 110.

In certain example embodiments, the mounting assembly 280 provides for mounting the floodlight 100 and/or adjusting the direction of the light generated by the light sources 190 of the floodlight 100. The mounting assembly 280 may be made of any suitable material, including metal (e.g., alloy, stainless steel), plastic, some other material, or any combination thereof. The mounting assembly 280 may be made of the same or a different material as the other components of the floodlight 100.

The example mounting assembly 280 of the floodlight 100 can include a mounting bracket 282, a hinge plate 284, and a yoke bracket 286. In certain example embodiments, the hinge plate 284 couples to the side 111 of the heat sink 191 of the light source housing assembly 110. For example, as shown in FIGS. 1A-2C, the hinge plate 284 can be coupled to the one or more coupling features 107 positioned toward the bottom of the side 111 of the heat sink 191 of the light source housing assembly 110. The hinge plate 284 may be coupled to the light source housing assembly 110 in one or more of a number of ways, including but not limited to epoxy, welding/soldering, and fastening devices 105.

The hinge plate 284, yoke bracket 286, and/or mounting bracket 282 may be made of one or more of a number of materials, including but not limited to aluminum, an alloy, plastic, and stainless steel. The characteristics (e.g., dimensions, shape, material) of the components (e.g., mounting bracket 282, hinge plate 284, yoke bracket 286) of the mounting assembly 280 may be such that the mounting assembly 280 safely and reliably couples to the remainder of the floodlight 100 in any suitable environment and/or for any duration of time during the operation of the floodlight 100.

The yoke bracket 286 may include one or more features (e.g., slots) that allow a user to rotate, tilt, swivel, or otherwise move the light generated by the floodlight 100 in a particular vertical direction and/or angled position. For example, the yoke bracket 286 in FIGS. 1A-2C allow the light generated by the floodlight 100 to be directed at any point within a 180° arc. There may be more than one yoke bracket 286 for the mounting assembly 280. The mounting bracket 282 may be coupled to the yoke bracket 286. The mounting bracket 282 may be coupled to an external feature (e.g., a pole, a side of a building) to secure the floodlight 100 in a fixed or relative position. The mounting bracket 282 may be coupled to one or more such external features in one or more of a number of ways, including but not limited to fastening devices (e.g., bolts) that traverse apertures in the mounting bracket 282.

The heat sink 191 of the light source housing assembly 110 may be a single piece (as from a cast) or multiple pieces that are mechanically coupled to each other using one or more of a number of coupling methods, including but not limited to welding, fastening devices, and compression fittings. The light source housing assembly 110 may be made of one or more of a number of suitable materials, including metal (e.g., alloy, stainless steel), plastic, some other material, or any combination thereof. In certain example embodiments, the heat sink 191 of the light source housing assembly 110 is thermally conductive. The light source housing assembly 110 (or portions thereof) may be of any dimensions (e.g., thickness, width, height) suitable for the environment in which the floodlight 100 operates. For example, the thickness of the walls of the heat sink 191 may be a minimum amount required to meet the applicable standards. As another example, the flange 125 of the heat sink 191 may be approximately 21 inches wide by approximately 16 inches high.

The bezel 109 can include one or more of a number of coupling features 114. The coupling features 114 of the bezel 109 can be used, directly or indirectly, to couple the bezel 109 to one or more components of the floodlight 100. For example, the bezel 109 of the floodlight 100 can be mechanically coupled to the light source housing assembly 110 using the coupling features 114. Specifically, as shown in FIGS. 1A-2C, the coupling features 114 of the bezel 109 can be mechanically coupled to the coupling features 123 of the flange 125. In certain example embodiments, the coupling features 114 of the bezel 109 can also be used to mechanically couple one or more of a number of other optional components of the floodlight 100 to the bezel 109. Examples of such features can include, but are not limited to, a visor, a guard, and a lens (all not shown).

Examples of the coupling features 114 of the bezel 109 may include, but are not limited to, an aperture (as shown), a slot, a tab, a joint, a clamp, and a fastening device. The bezel 109 can, using the coupling features 114, mechanically couple to the flange 125 of the heat sink 191 (or some other component of the floodlight 100) using one or more of a number of coupling methods, including but not limited to bolting, welding, using epoxy, brazing, press fitting, mechanically connecting, using a flat joint, and using a serrated joint. For example, as shown in FIGS. 1A-2C, the coupling features 114 (apertures, in this case) traverse the bezel 109 and align with coupling features 123 (also apertures) that traverse the flange 125 in the heat sink 191 so that, when the bezel 109 is positioned in a certain way with respect the heat sink 191, the coupling features 114 and the coupling features 123 align. In such a case, one or more of a number of fastening devices (e.g., screws, bolts) may traverse the coupling features 114 and the coupling features 123 to couple the bezel 109 to the flange 125 of the heat sink 191.

Some or all of the surface (e.g., where the bezel 109 and/or sealing device 124 couples to the flange 125 of the heat sink 191) of the flange 125 of the heat sink 191 may be free of paint to provide a better seal and assure compliance with one or more of a number of standards, including but not limited to IP66. The bezel 109 may be of any thickness and/or width (e.g., the distance from the outer edge 116 toward an inner edge 108 of the bezel 118). The bezel 109 may be used for aesthetic and/or protective purposes. The bezel 109 may include one or more components, including but not limited to a sealing device 124 (e.g., a gasket, an o-ring) positioned between the back side of the bezel 109 and the flange 125 of the heat sink 191. In certain example embodiments, the bezel 109 and/or the front side 121 of the light source housing assembly 110 include a channel into which the sealing device 124 can be disposed. The sealing device 124 can be made of one or more of a number of thermally insulating materials, which allows the sealing device 124 to provide thermal isolation between the bezel 109 and front side 121 of the heat sink 191.

The bezel 109 may also, or in the alternative, be used to secure a lens (not shown). The front surface 118 of the bezel 109 can be of any color and/or texture. An aperture 117 can traverse a middle portion of the bezel 109 to expose the one or more light sources 190. In certain example embodiments, the outer edge 116 of the bezel 109 can be the same shape as, and slightly larger than, the outer edge 127 of the flange 125 of the heat sink 191. In such a case, when the bezel 109 is coupled to the heat sink 191, the outer edge 116 of the bezel 109 fits over the outer edge 127 of the flange 125, as shown in FIGS. 1A-2C.

In certain example embodiments, the light source housing assembly 110 includes an optional wiring channel 162 that traverses the heat sink 191 from the front side 121 beyond the back side 113. In some cases, the optional wiring channel 162 extends beyond the back side 113 substantially to the ends of the protrusions 112. The wiring channel 162 can receive one or more electrically conductive wires and/or one or more cables that are electrically coupled to the light sources 190 disposed on the front side 121 of the heat sink 191 and to the power source assemblies 160 located in the power source housing assembly 150, as described below. If there is no wiring channel 162, the light sources 190 can be electrically coupled to the power source assemblies 160 in any of a number of other ways using wired and/or wireless technology. For example, one or more electrically conductive wires can be electrically and mechanically coupled to connector receivers disposed on the back side 113 of the heat sink 191.

A sealing device 161 can be positioned at the end of the wiring channel 162 between the wiring channel 162 of the light source housing assembly 110 and a wiring channel 163 of the intermediate housing assembly 130. The sealing device 161 can be made of one or more materials such that the sealing device 161 provides thermal isolation between the wiring channel 162 of the light source housing assembly 110 and the corresponding wiring channel 163 of the intermediate housing assembly 130. The sealing device 161 can be, for example, a gasket or an o-ring. In certain example embodiments, the distal end of the wiring channel 162 of the light source housing assembly 110 and/or the proximal end of the wiring channel 163 of the intermediate housing assembly 130 includes a channel into which the sealing device 161 can be disposed. In such a case, the sealing device 161 can be made of a thermally insulating material that provides thermal isolation between the wiring channel 162 of the light source housing assembly 110 and the wiring channel 163 of the intermediate housing assembly 130.

The light sources 190 of the light source housing assembly 110 can includes a number of light sources that can be LED and/or any other type of light source, as explained above. The light sources 190 may be an array of LEDs (or other type of light sources using some other lighting technology) or a single LED (or other type of light source using some other lighting technology). If the light sources 190 are in fact LEDs, the light sources 190 may be one or more of any type of LED, including but not limited to chip-on-board and discrete. A thermal pad (not shown) and/or any other similar thermal device may be positioned between the light sources 190 and the front side 121 of the heat sink 191. One or more reflectors and/or reflector arrays may be positioned over one or more of the light sources of the light sources 190. Any reflectors, light sources, and/or any other components (e.g., thermal pads) associated with the light sources 190 may be coupled to the front side 121 of the heat sink 191 using one or more of a number coupling methods, including but not limited to epoxy, fastening devices (e.g., screws), snap fittings, and welding/soldering. One or more portions of the front side 121 of the heat sink 191 may be raised or recessed to receive and/or dissipate heat generated by the light sources 190.

In certain example embodiments, the power source housing assembly 150 includes a heat sink 193 and at least one power source assembly 160. The heat sink 193 can have a front side 164 (defined by the flange 175 around the outer perimeter of the front side 164 of the heat sink 193) and a back side 153. The front side 164 of the heat sink 193 may be larger (e.g., wider, higher) than the back side 153 of the heat sink 193. The heat sink 193 of the power source housing assembly 150 can form a cavity 171, into which the one or more power source assemblies 160 are disposed. For example, the one or more power source assemblies 160 can be mechanically coupled to the back side 153 of the heat sink 193.

The one or more coupling features 173 disposed on the flange 175 (or, in certain example embodiments, on other portions of the heat sink 193) of the power source housing assembly 150 can allow the heat sink 193 to become mechanically coupled, directly or indirectly, to one or more other components of the floodlight 100. For example, the one or more coupling features 173 of the flange 175 can be used to mechanically couple the heat sink 193 to the intermediate housing assembly 192. The coupling features 173 can include, but are not limited to, a portion of a hinge, an aperture (as shown), a slot, a tab, a detent, and a mating thread. The heat sink 193 and another component of the floodlight 100 can be coupled to each other by the direct use of the coupling features 173. In addition, or in the alternative, the heat sink 193 and another component of the floodlight 100 can be coupled to each other using one or more independent devices that interact with the coupling features 173 disposed on the flange 175 of the heat sink 193. Examples of such devices can include, but are not limited to, a pin, a hinge, a fastening device 105 (e.g., screw, bolt), and a spring.

In certain example embodiments, the heat sink 193 can include one or more protrusions 152 extending from the back side 153 of the heat sink 193. The protrusions 152 can be called fins or some similar name. The protrusions 152 can be used to increase the effective surface area of the back side 153 of the heat sink 193. In such a case, the protrusions 152 and the back side 153 of the heat sink 193 can dissipate heat absorbed from the at least one light source 190 more efficiently. In certain example embodiments, in addition to extending beyond the back side 153 of the heat sink, the protrusions can extend outward from the top, one or both sides 151, and/or the bottom of the heat sink 193.

In certain example embodiments, the protrusions 152 provide one or more air gaps 102 with the back side 153 of the heat sink 193 to maintain the temperature of the power source housing assembly 150 below a threshold temperature. The protrusions 152 of the heat sink 193 may have varying shapes (e.g., thickness, height, curvature) and/or varying spacing extending from the heat sink 193. For example, the protrusions 152 may be fins (e.g., blades). As another example, the protrusions 152 may be one or more undulations (e.g., a number of sine waves in series). The protrusions 152 may extend from the back side 153 of the heat sink 193 perpendicularly or at some non-normal angle. Each protrusion 152 may extend from the back side 153 of the heat sink 193 at the same or different angles relative to the other protrusions 152.

The protrusions 152 may have any of a number of configurations. As shown in FIGS. 1A-2C, the protrusions 152 may be linear. In such a case, the linear protrusions 152 may have a number of orientations along the back side 153 of the heat sink 193. For example, the protrusions 152 may be parallel to each other and run vertically along at least a portion of the height of the back side 153 of the heat sink 193. The protrusions 152 may also be parallel to each other and run horizontally along at least a portion of the width of the back side 153 of the heat sink 193. The protrusions 152 may also be parallel to each other and run diagonally, at any of a number of angles, along at least a portion of the width of the back side 153 of the heat sink 193.

The protrusions 152 may also run quasi-parallel to each other. In a quasi-parallel configuration, a portion of the protrusions 152 may be parallel to each other, while the remainder of the protrusions 152 are not parallel to the portion of parallel protrusion(s) 152. Those skilled in the art will appreciate that a number of other quasi-parallel configurations of the protrusions 152 along the back side 153 of the heat sink 193 may be attained. The protrusions 152 may also be non-linear and/or oriented antiparallel to each other. For example, the protrusions 152 may be sine waves that run parallel to each other in some orientation (e.g., vertical, horizontal) along the back side 153 of the heat sink 193. As another example, the protrusions 152 may be concentric circles, positioned along the back side 153 of the heat sink 193, that are centered at the center of the heat sink 193. Those skilled in the art will appreciate that a number of other non-linear and antiparallel configurations of the protrusions 152 along the back side 153 of the heat sink 193 may be attained.

The protrusions 152 can be made of one or more of a number of thermally conductive materials. The protrusions 152 can be made of the same, or different, material compared to the material of the rest of the heat sink 193. The protrusions 152 can be part of a single piece with the rest of the heat sink 193. Alternatively, the protrusions 152 can be mechanically coupled to the rest of the heat sink 193 using one or more of a number of coupling methods, including but not limited to welding, compression fittings, and fastening devices. In certain example embodiments, the protrusions 152 can be considered part of the back side 153 of the heat sink 193.

The heat sink 193 of the power source housing assembly 150 may be a single piece (as from a cast) or multiple pieces that are mechanically coupled to each other using one or more of a number of coupling methods, including but not limited to welding, fastening devices, and compression fittings. The power source housing assembly 150 may be made of one or more of a number of suitable materials, including metal (e.g., alloy, stainless steel), plastic, some other material, or any combination thereof. The heat sink 153 of the power source housing assembly 150 may be made of the same or a different material as the heat sink 191 of the light source housing assembly 110.

In certain example embodiments, the heat sink 193 of the power source housing assembly 150 is thermally conductive. The power source housing assembly 150 (or portions thereof) may be of any dimensions (e.g., thickness, width, height) suitable for the environment in which the floodlight 100 operates. For example, the thickness of the walls of the heat sink 193 may be a minimum amount required to meet the applicable standards. As another example, the width and height of the flange 175 of the heat sink 193 may be proportionately less than the width and height of the back side 133 of the intermediate housing assembly 192.

A sealing device 140 can be positioned between the flange 175 (or some other portion of the front side 164) of the heat sink 193 and the back side 133 of the intermediate housing assembly 130. The sealing device 140 can be made of one or more materials such that the sealing device 140 provides thermal isolation between the heat sink 193 and the intermediate housing assembly 130. The sealing device 140 can be, for example, a gasket or an o-ring. In certain example embodiments, the flange 175 of the heat sink 193 and/or the back side 133 of the intermediate housing assembly 130 includes a channel into which the sealing device 140 can be disposed. The sealing device 140 can be made of one or more of a number of thermally insulating materials, which allows the sealing device 140 to provide thermal isolation between the front side 164 of the heat sink 193 and the back side 133 of the intermediate housing assembly 130.

In one or more embodiments, one or more inner surfaces (within the cavity 171) of the heat sink 193 of the power source housing assembly 150 receives one or more power source assemblies 160. A power source assembly 160 can include one or more of a number of components used to create power and control for the floodlight 100. Such components of the power source assembly 160 can include, but are not limited to, drivers (or some other kind of power supply), a driver bracket, a transformer, a resistor, a diode, and integrated circuit, and an inductor. The cavity 171 of the heat sink 193 may be of any size (e.g., depth, width, height) for proper ventilation and/or cooling of power source assemblies 160 disposed within the heat sink 193.

The inner surface of the back wall 153 of the heat sink 193 may receive the one or more components using one or more of a number of coupling features. Such coupling features can include, but are not limited to, apertures (for fastening devices), slots, and clamps. In addition, or in the alternative, one or more components of the power source assembly 160 can be coupled to the back wall 153 of the heat sink 193 using one or more of a number of other coupling methods, including but not limited to welding, compression fittings, and epoxy. While the power source assemblies 160 are shown and described herein as being mechanically coupled to the inner surface of the back wall 153 of the heat sink 193, the power source assemblies 160 may, alternatively or in addition, be mechanically coupled to an inner surface of a side 152, top, and/or bottom of the heat sink 193.

The heat sink 193 of the power source housing assembly 150 can also include one or more wiring channels (hidden from view) that traverse a wall of the heat sink 193. In such a case, the power source housing assembly can include a cable gland 149 disposed within the wiring channel of the heat sink 193. The cable gland 149 can have one or more coupling features (e.g., mating threads) that allow the cable gland 149 to mechanically couple to the electrical wiring channel of the heat sink 193. The cable gland 149 (either by itself or in conjunction with another device, including but not limited to a sealing device and a silicone caulk) can be used to provide a seal between the cable gland 149 and the heat sink 193. The cable gland 149 can also provide a seal between the cable gland 149 and one or more cables that are disposed within the cable gland 149. In any case, such a seal can prevent water, dust, and other contaminants from outside the power source housing assembly 150 from entering the cavity 171 of the power source housing assembly 150.

In certain example embodiments, the intermediate housing assembly 130 is one or more pieces that are designed to provide a physical separation between the light source housing assembly 110 and the power source housing assembly 150. For example, the intermediate housing assembly 130 can include a heat sink 192. The intermediate housing assembly 130 can be made of one or more of a number of thermally conductive materials. The intermediate housing assembly 130 can have a front side 141 (defined by the flange 135 around the outer perimeter of the front side 141) and a back side 133. The front side 141 of the intermediate housing assembly 130 may be smaller (e.g., less wide, less high) than the back side 153 of the heat sink 191. The intermediate housing assembly 130 can form a cavity 139 through which one or more electrically conductive wires (e.g., electrically coupling the light sources 190 to the power source assemblies 160) are disposed. In some cases, the back side 133 of the intermediate housing assembly 130 has an opening, such that the cavity 171 of the power source housing assembly 150 extends to the front side 141 of the intermediate housing assembly 130.

The flange 135 of the intermediate housing assembly 130 can include one or more of a number of coupling features 143. The one or more coupling features 143 disposed on the flange 135 (or, in certain example embodiments, on other portions of the front side 141) of the intermediate housing assembly 130 can allow the intermediate housing assembly 130 to become mechanically coupled, directly or indirectly, to one or more other components of the floodlight 100. For example, the one or more coupling features 143 of the flange 135 can be used to mechanically couple the heat sink 191 of the light source housing assembly 110 to the intermediate housing assembly 192.

The coupling features 143 can include, but are not limited to, a portion of a hinge, an aperture (as shown), a slot, a tab, a detent, and a mating thread. The intermediate housing assembly 130 and another component of the floodlight 100 can be coupled to each other by the direct use of the coupling features 143. In addition, or in the alternative, the intermediate housing assembly 130 and another component of the floodlight 100 can be coupled to each other using one or more independent devices that interact with the coupling features 143 disposed on the flange 135 of the intermediate housing assembly 130. Examples of such devices can include, but are not limited to, a pin, a hinge, a fastening device 105 (e.g., screw, bolt), and a spring.

Similar to the front side 141 of the intermediate housing assembly 130, the back side 133 of the intermediate housing assembly 130 can include one or more of a number of coupling features (hidden from view). Such one or more coupling features disposed on the back side 133 of the intermediate housing assembly 130 can allow the intermediate housing assembly 130 to become mechanically coupled, directly or indirectly, to one or more other components of the floodlight 100. For example, the one or more coupling features of the back side 133 of the intermediate housing assembly 130 can be used to mechanically couple the heat sink 193 of the power source housing assembly 150 to the intermediate housing assembly 130. The coupling features of the back side 133 of the intermediate housing assembly can be the same as, or different than, the coupling features 128 described above with respect to the light source housing assembly 110.

The length and width of the flange 135 and the length and width of the back side 133 of the intermediate housing assembly 130 can be the same as or different than each other. The length and width of the flange of the intermediate housing assembly 130 can be substantially the same as the length and width of the back side 113 of the light source housing assembly 110. The length and width of the back side 133 of the intermediate housing assembly 130 can be substantially the same as the length and width of the flange 175 of the power source housing assembly 150.

If the intermediate housing assembly 130 includes a heat sink 192, the heat sink 192 can include one or more of a number of protrusions 132. The protrusions 132 can extend outward from any surface of the heat sink 192, including but not limited to the top, the bottom, one or both sides 131, and the back side 133. The protrusions 132 can be called fins or some similar name. The protrusions 132 can be used to increase the effective surface area of the heat sink 193. In such a case, the protrusions 132 and one or more portions (e.g., the back side 133, the sides 131) of the heat sink 192 can dissipate heat absorbed from the heat sink 191 of the light source housing assembly 110 and/or the heat sink 193 of the power source housing assembly 150 more efficiently.

In certain example embodiments, the protrusions 132 provide one or more air gaps to maintain the temperature of the power source housing assembly 150 below a threshold temperature. For example, if the protrusions 132 extend from the back side 133 of the heat sink 192, one or more air gaps can be formed between the protrusions 132, the back side 133 of the heat sink 192, and the front side 161 of the heat sink 193. Such air gaps can be substantially similar to the air gaps 101 and/or the air gaps 102 described above. Similarly, the protrusions 132 can be substantially the same as the protrusions 112 and/or the protrusions 152 described above.

In certain example embodiments, a wiring aperture 163, corresponding to the wiring aperture 162 of the light source housing assembly 110, traverses the intermediate housing assembly 130 and receives one or more electrically conductive wires and/or one or more cables that are electrically coupled to the light sources 190 of the light source housing assembly 110 and to the power source assemblies 160 located in the heat sink 191 of the power source housing assembly 150.

The floodlight 100 may be able to withstand one or more of a number of harsh environmental conditions. For example, the floodlight 100 may be able to withstand a minimum amount of vibration for a minimum amount of time while operating. As another example, the floodlight 100 may be able to withstand exposure to a minimum amount of water for a minimum amount of time.

In certain example embodiments, the floodlight 100 is made of one or more cast components. In such a case, one or more of the cast components are finished with a grey epoxy powder coat paint. The grey epoxy powder coat paint may provide protection against fade and ware. The grey epoxy powder coat paint may be applied to the cast components in any thickness (e.g., 1 mill, 5 mils).

The shape of the light source housing assembly 110, the intermediate housing assembly 130, and the power source housing assembly 150, as shown in FIGS. 1A-2C, are rectangular. However, other shapes (e.g., square, elliptical) may be used for one or more portions of the light source housing assembly 110, the intermediate housing assembly 130, and the power source housing assembly 150. For example, the shape of the front side 121 of the light source housing assembly 110 and the shape of the bezel 109 may be circular.

Figure 3:
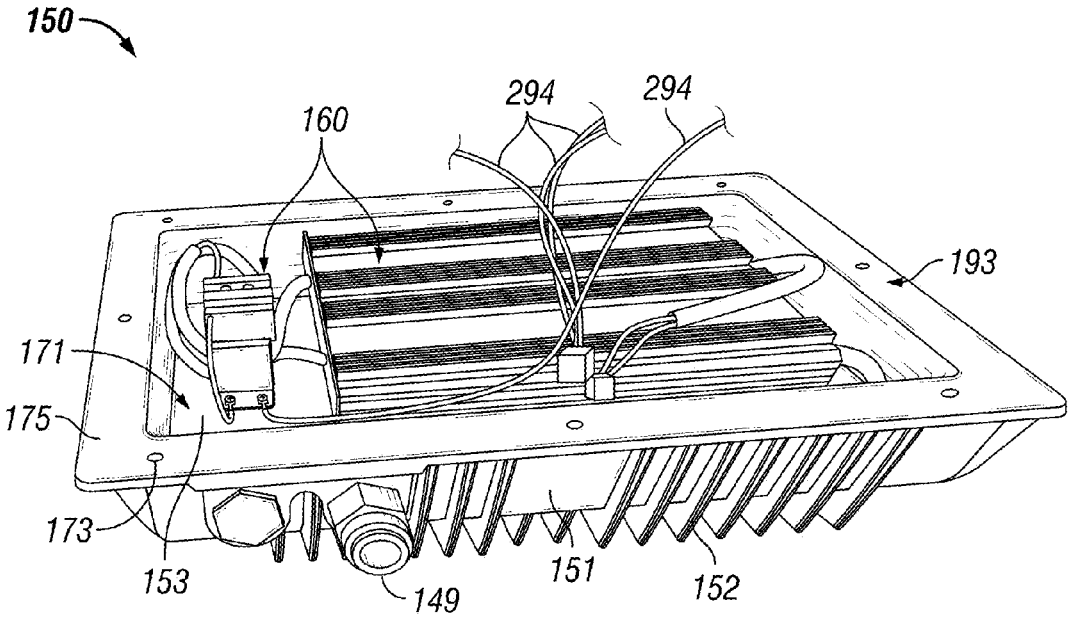
FIG. 3 shows a perspective view of a power source housing assembly of a floodlight in accordance with certain example embodiments.

FIG. 3 shows a top perspective view of a power source housing assembly 150 a floodlight in accordance with certain example embodiments. In one or more embodiments, one or more of the components shown in FIG. 3 may be omitted, repeated, and/or substituted. Accordingly, embodiments of a power source housing assembly of a floodlight should not be considered limited to the specific arrangements of components shown in FIG. 3.

The power source housing assembly 150 of FIG. 3 is substantially similar to the power source housing assembly 150 of FIGS. 1A-2C. Any components of FIG. 3 that are labeled but not described with respect to FIG. 3 can be described by the corresponding component of the power source housing assembly 150 of FIGS. 1A-2C. Referring to FIG. 3, the power source assembly 160 is shown disposed within the cavity 171 of the heat sink 193. Specifically, the power source assembly 160 of FIG. 3 is mechanically coupled to the inner surface of the back side 153 of the heat sink 193. In this way, heat generated by the power source assembly 160 can be more quickly and efficiently transferred through the back side 153 of the heat sink 193 and to the ambient air.

FIG. 3 also shows examples of a number of wires 394 that are, at one end, electrically and mechanically coupled to one or more components of the power source assembly 160. The other end of such wires 394 can extend through the wiring channel 163 of the intermediate housing assembly 130 and the wiring channel 162 of the light source housing assembly 110 and can be electrically and mechanically coupled to the light sources 190. Each wire 394 can be electrically conductive.

Figure 4:
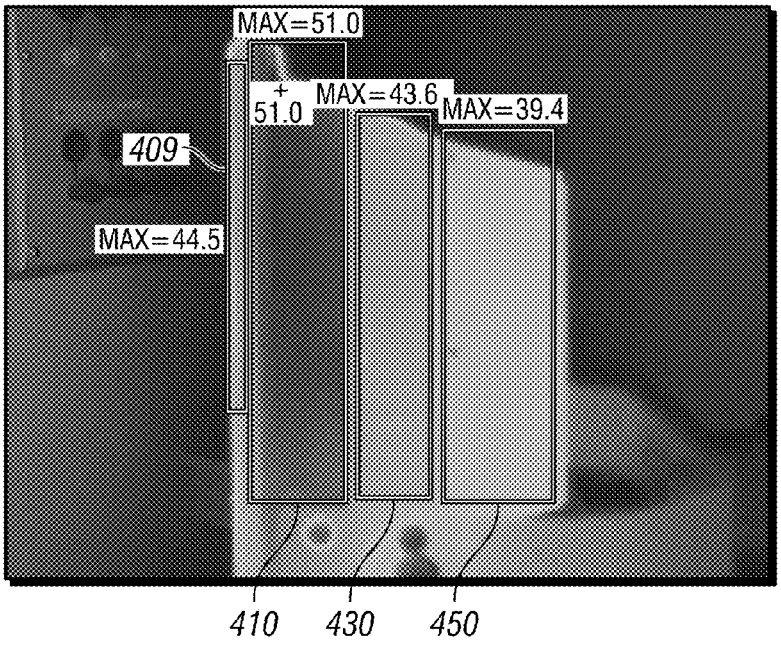
FIG. 4 shows a thermal image of a floodlight in accordance with certain example embodiments.

FIG. 4 shows a thermal image 400 of the floodlight 100 of FIGS. 1A-2C in accordance with certain example embodiments. The thermal image 400 shows the cooling efficiency of the various air gaps formed by and, in some cases, between one or more housing assemblies of the floodlight 100. The thermal image 400 shows that the steady state temperature 409 of the bezel 109 when the floodlight 100 is operating is approximately 44.5° C. The thermal image 400 shows that the steady state temperature 410 of the light source housing assembly 110 when the floodlight 100 is operating is approximately 51.0° C. The thermal image 400 shows that the steady state temperature 330 of the intermediate housing assembly 130 when the floodlight 100 is operating is approximately 43.6° C. Finally, the thermal image 400 shows that the steady state temperature 350 of the power source housing assembly 150 when the floodlight 100 is operating is approximately 39.4° C. Thus, the floodlight 100, using example embodiments, can operate for a longer period of time without one or more components failing due to high temperatures generated by components of the floodlight 100 during steady state operation.

Embodiments of the present invention provide for floodlights of various shapes and sizes where heat sink protrusions are strategically placed between the light source housing assembly, the intermediate housing assembly, and/or the power source housing assembly to allow for improved air flow using multiple cooling paths to improve the reliability and availability of the floodlight by keeping the temperature of the floodlight (or portions thereof) below a threshold temperature. Example embodiments of the floodlights described herein are designed to meet one or more of a number of standards and/or regulations to be used in a variety of conditions.

Although the inventions are described with reference to preferred embodiments, it should be appreciated by those skilled in the art that various modifications are well within the scope of the invention. From the foregoing, it will be appreciated that embodiments of the floodlight overcome the limitations of the prior art. Those skilled in the art will appreciate that floodlights are not limited to any specifically discussed application and that the embodiments described herein are illustrative and not restrictive. From the description of the example embodiments, equivalents of the elements shown therein will suggest themselves to those skilled in the art, and ways of constructing other embodiments of the floodlight will suggest themselves to practitioners of the art. Therefore, the scope of the floodlight is not limited herein.

What is claimed is:

1. A floodlight, comprising:

a light source housing assembly comprising:

a thermally conductive first heat sink comprising a first front side and a first back side, wherein the first back side comprises a first plurality of protrusions extending from a first remainder of the first back side, wherein the first plurality of protrusions are substantially parallel with each other; and at least one light source mounted to the first front side of the first heat sink;

a power source housing assembly comprising:

a thermally conductive second heat sink comprising a second front side and a second back side; and at least one power source assembly mounted to the second back side of the second heat sink and electrically coupled to the at least one light source; and an intermediate housing assembly disposed between and mechanically coupled to the light source housing assembly and the power source housing assembly, wherein the intermediate housing assembly comprises a third front side and a third back side, wherein the first remainder of the first back side, the first plurality of protrusions, and the third front side form a first plurality of air gaps, wherein ambient air flows through the first plurality of air gaps using natural convection and without a device that generates air flow through the first plurality of air gaps.

2. The floodlight of claim 1, wherein the first plurality of protrusions heats to a first temperature when the at least one light source is illuminated, wherein the first temperature is greater than an ambient temperature.

3. The floodlight of claim 2, wherein the ambient air flowing through the first plurality of air gaps causes the first plurality of protrusions to cool to a second temperature, wherein the second temperature is greater than the ambient temperature and less than the first temperature.

4. The floodlight of claim 3, wherein the ambient air flows through the first plurality of air gaps based on a pressure differential between the first plurality of air gaps and outside the first plurality of air gaps.

5. The floodlight of claim 1, wherein the second back side comprises a second plurality of protrusions extending from a second remainder of the second back side, wherein the second plurality of protrusions and the second remainder of the second back side form a second plurality of air gaps.

6. The floodlight of claim 1, wherein the third back side of the intermediate housing assembly comprises a third plurality of protrusions extending from a third remainder of the third back side.

7. The floodlight of claim 6, wherein the third plurality of protrusions, the third remainder of the third back side, and the second front side of the second heat sink form a third plurality of air gaps.

8. The floodlight of claim 7, wherein the third plurality of protrusions heats to a first temperature when the at least one light source is illuminated, wherein the first temperature is greater than an ambient temperature.

9. The floodlight of claim 8, wherein additional ambient air flows through the third plurality of air gaps, causing the third plurality of protrusions to cool to a second temperature, wherein the second temperature is greater than the ambient temperature and less than the first temperature.

10. The floodlight of claim 9, wherein the additional ambient air flows through the third plurality of air gaps based on a pressure differential between the third plurality of air gaps and outside the third plurality of air gaps.

11. The floodlight of claim 1, wherein the intermediate housing assembly is thermally conductive.

12. The floodlight of claim 1, wherein the second front side and the third back side form a cavity.

13. The floodlight of claim 12, further comprising:

at least one electrically conductive wire disposed within the cavity and comprising a first end and a second end, wherein the first end is electrically coupled to the at least one light source, and wherein the second end is electrically coupled to the at least one power source assembly.

14. The floodlight of claim 13, wherein the light source housing assembly further comprises a first wiring channel that traverses a portion of the first back side and extends beyond the first remainder of the first back side, wherein the first end of the at least one electrically conductive wire is disposed in the first wiring channel.

15. The floodlight of claim 14, further comprising:

a sealing device disposed between a distal end of the first wiring channel and a proximal end of a second wiring channel disposed in the third front side of the intermediate housing assembly.

16. The floodlight of claim 15, wherein the sealing device comprises a thermally insulating material that provides thermal isolation between the first wiring channel of the light source housing assembly and the second wiring channel of the intermediate housing assembly.

17. The floodlight of claim 1, further comprising:

a first sealing device disposed between the second front side of the second heat sink and the third back side of the intermediate housing assembly.

18. The floodlight of claim 17, wherein the first sealing device comprises a first thermally insulating material that provides thermal isolation between the second front side of the second heat sink and the third back side of the intermediate housing assembly.

19. The floodlight of claim 18, further comprising:

a bezel mechanically coupled to the first front side of the first heat sink; and a second sealing device disposed between the bezel and first front side of the first heat sink.

20. The floodlight of claim 19, wherein the second sealing device comprises a second thermally insulating material that provides thermal isolation between the bezel and first front side of the first heat sink.

* * * * *